US005512230A

United States Patent [19]

Cannon, III

[11] Patent Number: 5,512,230

[45] Date of Patent: Apr. 30, 1996

[54] PROCESS FOR MAKING CELLULOSE ACETATE FIBERS

[75] Inventor: Jesse N. Cannon, III, Kingsport, Tenn.

[73] Assignee: Eastman Chemical Company, Kingsport, Tenn.

[21] Appl. No.: 351,923

[22] Filed: Dec. 8, 1994

[51] Int. Cl.[6] ..... D01F 2/28

[52] U.S. Cl. ..... 264/169; 264/200; 264/207; 264/211

[58] Field of Search ..... 264/169, 200, 264/207, 211

[56] References Cited

U.S. PATENT DOCUMENTS 5,240,665 8/1993 Seo et al. ..... 264/169

FOREIGN PATENT DOCUMENTS 597478 5/1994 European Pat. Off. .
93/24685 5/1992 WIPO .

OTHER PUBLICATIONS

The Chemistry of Cellulose, by Emil Heuser, John Wiley & Sons, Inc., New York, pp. 267–270, QD 321 Heu (undated).

Colloid Symposium Monograph V, by Sheppard, Carver and Houck, 243 (1928).

Sheppard and Sweet, J. Phys. Chem., 36, 819 (1932).

Whitby, "Colloid Symposium Monograph IV", 203, (1926).

Werner and Engelmann, Z. Angew. Chem., 42, 443 (1929).

*Primary Examiner*—Leo B. Tentoni
*Attorney, Agent, or Firm*—Bernard J. Graves, Jr.; Harry J. Gwinnell

[57] ABSTRACT

A method for spinning a cellulose acetate fiber having a low degree of substitution per anhydroglucose unit (DS/AGU) of the cellulose acetate is provided. The addition of 5 to 40 weight percent water to cellulose acetate(CA)/acetone spinning solutions (dopes) will produce dopes that will allow fibers to be solvent spun using CA with a DS/AGU from 1.9 to 2.2.

6 Claims, No Drawings

PROCESS FOR MAKING CELLULOSE ACETATE FIBERS

FIELD OF THE INVENTION

This invention belongs to the field of cellulose chemistry. In particular, this invention provides a method for spinning cellulose acetate having a low DS/AGU range.

BACKGROUND OF THE INVENTION

Recent industry interest in the degradation potential of cigarette filters has prompted a research effort to improve the environmental degradation of cellulose acetate (CA) fibers. Biodegradation studies indicated that lowering the degree of substitution per anhydroglucose unit (DS/AGU) of the cellulose acetate below a level of 2.5 will result in an increase in the biodegradation rate of the cellulose acetate. However, the ability to spin such a polymer is problematic because of its modified solubility parameters.

The presence of small amounts of water in acetone/CA dopes is well known to the industry. Much of the water found in conventional acetone/CA dopes is the residual left in the incompletely dried CA flake and in the acetone solvent used to make the dopes. These water levels are controlled because it is recognized that variation in this level does have an affect on dope viscosity. For example, the use of small amounts of water (95:5 acetone/water) in acetone dopes of 25% CA with a DS of 2.4 to reduce the viscosity of the solution is described by H. W. Steinman in the *Handbook of Fiber Science and Technology: Fiber Chemistry* (Menachem Lewin and Eli M. Pearce Ed.) vol. 5. Marcel Dekker, New York, p. 1025.

The connection between the solubility of CA in acetone and the degree of substitution of the CA has also been studied. *The Chemistry of Cellulose,* by Emil Heuser, John Wiley & Sons, Inc., New York, p. 267–270, states that the "acetone-solubility range of commercial secondary acetates comprises an acetyl content between 35.8% and 41.5%" which corresponds to a range of DS of about 2.1 to 2.7. This reference discusses the variables affecting the solubility of cellulose acetate and identifies degree of polymerization, physical form, degree of substitution, and solvent type as the major variables. This reference also notes that if the degree of polymerization and physical form is neglected, the most satisfactory explanation for solubility or lack of solubility of CA is based on the relative amounts of polar and nonpolar groups in the solvent and the CA. Also noted therein are the results of a number of studies done during the 1920's and 1930's on the solubility of CA and the affect of water on this solubility.

In "Colloid Symposium Monograph V", by Sheppard, Carver, and Houck, 243 (1928), the authors note: "maximum solvent power when a certain quantity of water had been added to the solvent". In Sheppard and Sweet, *J. Phys. Chem.,* 36, 819 (1932), the authors note: "when a certain quantity of a non-solvent was added to an acetone acetate solution, a point was established at which the nonsolvent developed solvent properties in conjunction with the acetone". (See also, Whitby, "Colloid Symposium Monograph IV", 203 (1926)). In Werner and Engelmann, *Z. Angew. Chem.,* 42,443 (1929), the authors note "acetone-insoluble acetate (containing 50 percent combined acetic acid) was soluble in a mixture of acetone and alcohol or acetone and water".

European Patent Application 597 478, (in Example 6) describes using 2.14 DS cellulose acetate to produce a 5 denier per filament fiber by dry spinning. This reference shows the preparation of formulated spinning dope by dissolving the low DS cellulose acetate in a 96.5/3.5 by weight mixed solvent of acetone and water. The actual water level in the DOPE solution works out to about 2.5 weight percent.

However, none of the prior art makes the connection between the successful dry spinning of low DS cellulose acetate fibers and the importance of higher than normal levels (5 weight percent or more) of water in the CA/acetone dopes. They also do not recognize that the percentage of water in the DOPE solution is the most important factor. The prior art references generally quote an acetone/water ratio in the solvent and do not take into account the fact that as CA is added to the solvent the percentage of water relative to the total solution is reduced.

SUMMARY OF THE INVENTION

Recent industry interest in the degradation potential of cigarette filters has prompted research to improve the environmental degradation of cellulose acetate (CA) fibers. Biodegradation studies indicated that lowering the degree of substitution per anhydro-glucose unit (DS/AGU) of the cellulose acetate below the a level of 2.5 would speed up the biodegradation rate of the cellulose acetate. However, the ability to spin such a polymer because of its modified solubility parameters is problematic. This invention provides a solution to this problem. I have found that the addition of 5 to 40 weight percent water to cellulose acetate(CA)/acetone spinning solutions (dopes) will produce dopes that will allow fibers to be solvent spun using CA with a DS/AGU from 1.9 to 2.2.

DETAILED DESCRIPTION OF THE INVENTION

This present invention concerns the proper formulation of a spinning solution to make possible solvent (dry) spinning of fibers containing CA with a DS/AGU between 1.9 and 2.2. More specifically, the addition of from 5 to 40 weight percent water in acetone/CA dopes is required for a spinnable dope to be made with cellulose acetates with a DS/AGU from 1.9 to 2.2. Thus, the present invention provides a method for the production of cellulose acetate fibers comprising (I) forming a solution comprising (a) about 10 to 40 weight percent, based on the total weight of (a), (b), and (c), of cellulose acetate having a DS/AGU of from 1.9 to 2.2;

(b) about 20 to 85 weight percent, based on the total weight of (a), (b), and (c), of acetone;

(c) about 5 to 40 weight percent, based on the total weight of (a), (b), and (c), of water;

said solution having a zero shear viscosity at 29° C. of about 100 to about 10,000 poise;

(II) filtering said solution to form a spinning solution; followed by (III) spinning said spinning solution at a temperature of about 25° C. to 95° C., at 200 to 1,500 meter/min. through spinnerette holes having a hole area equivalent to a circular diameter of 20 to 100 microns and length to diameter ratio of 0.5 to 3, thereby forming a cellulose acetate fiber having a dry linear density of 0.5 to 20 denier per filament and a total product denier of from 10,000 to 100,000 denier.

As used herein, a spinnable dope is defined as a dope that can be spun into fibers using conventional solvent spinning process conditions and equipment such as is commercially available. Examples of spinning methodology can be found in U.S. Pat. No. 5,240,665, incorporated herein by reference. Typically these cellulose acetates have an inherent viscosity of about 1.0 to 1.8 deciliters/gram as measured at a temperature of 25 degrees centigrade for a 0.5 gram sample in 100 milliliters of a 60/40 parts by weight solution of phenol/tetrachloroethane. In addition, the water levels in these spinnable dopes can be further optimized to improve fiber shape factor and tensile properties.

In this regard, the dope of the present invention can be spun at a rate of about 200–1500 m/min. at 25°–95° C., preferably 45°–55° C. through spinnerette holes having a hole area equivalent to a circular diameter of 20–100 microns, preferably 30–70 microns, and length to diameter ratio between 0.5 and 3, forming filaments with dry linear densities of 0.5 to 20 denier per filament and a total product denier of 10,000 to 100,000 denier.

The extrudable solution according to the method of the present invention contains about 10 to 40 weight percent of cellulose acetate, about 20 to 85 weight percent of acetone, and about 5 to 40 weight percent of water. An amount of cellulose acetate much below about 10 percent is generally ineffective in spinning and an amount over 40 weight percent is generally too viscous to extrude, filter, spin, and convey. The solution's viscosity is not adjusted by changing the water level but by increasing or decreasing the percent CA in the dope solution at the expense of acetone. In a preferred embodiment, the spinning solution will contain about 10 to 15 weight percent water.

The extrudable solution preferably has a zero shear viscosity at 29° C., between about 200 and 4000 poise, more preferably between about 300 and 3000 poise.

After the fibers are spun, they can be treated as conventional fibers. They can be lubricated, dried, and subjected to standard processing steps.

EXPERIMENTAL SECTION

Example 1

It is desired to determine the amount of water required to make a spinnable dope using cellulose acetate with a DS of 2.1. A series of screening samples are made by adding 15 weight % 2.1 DS cellulose acetate to solutions containing varying amount of water and acetone. These mixtures are made up in 1 quart glass jars which are allowed to mix for 24 hours on a jar tumbler. The solutions are then evaluated visually to determine which mixtures produced a clear dope solution. The results are presented in Table 1. From this data it can be determined that a spinnable dope solution can be made using water levels between 10 and 40 weight percent.

TABLE 1

Results of mixture experiment to determine the amount of water required to make a spinnable dope using cellulose acetate with a DS of 2.1

| Cellulose Acetate (weight %) | Water (weight %) | Acetone (weight %) | Results |
|---|---|---|---|
| 15 | 0* | 85 | Dope is opaque. Many small gel particles. |
| 15 | 10 | 75 | Dope clear. No gels. |
| 15 | 20 | 65 | Dope clearer than 10% water sample. No gels. |
| 15 | 30 | 55 | Dope clear as 10% water sample above but color is more yellow. |
| 15 | 40 | 45 | Dope is not as clear as the 30% water sample. No gels. |

TABLE 1-continued

Results of mixture experiment to determine the amount of water required to make a spinnable dope using cellulose acetate with a DS of 2.1

| Cellulose Acetate (weight %) | Water (weight %) | Acetone (weight %) | Results |
|---|---|---|---|
| 15 | 50 | 35 | CA pellets are lumped together. Can see individual pellets in lump. |
| 15 | 60 | 25 | CA pellets lumped together and have retained their original shape. |

*The cellulose acetate and acetone were not dried so there is a small amount of water in these two components. Usually about 3 weight % of the CA and about 0.8 weight % of the acetone.

Example 2

It is desired to determine the optimum amount of water required in a spinning dope containing 2.0 DS cellulose acetate and acetone to produce a 3 Denier per Filament fiber suitable for filter tow. Using the method described in Example 1 a range of water levels that could be used is defined. In order determine an optimum level several dopes containing water levels from across this range are made up and spun into fiber. The percent cellulose acetate used in the mixtures to be studied is determined by measuring the dope viscosity and adjusting the percent cellulose acetate in the mixture until the viscosity matches that of a conventional 2.5 DS spinning dope. In this example it was determined that a dope with 26.2% cellulose acetate would give the correct viscosity. Fiber physical properties of the spun yarn are tested and used to determine the optimum water level required to produce a fiber suitable for filter tow.

TABLE 2

Properties of fibers spun from 2.0 DS cellulose acetate using different levels of water in the spinning dope

| Water in Dope (weight %) | Fiber Shape Factor | Fiber Tenacity (grams/-denier) | Fiber Percent Elongation To Break |
|---|---|---|---|
| 10 | 2.1 | 1.28 | 19.4 |
| 15 | 2.0 | 1.18 | 17.8 |
| 20 | 1.9 | 1.14 | 17.1 |
| 25 | 1.8 | 1.11 | 13.8 |

It can be seen form Table 2 that a 10% water level in the dope will produce the best fiber properties of shape factor, tenacity, and elongation, using 2.0 DS cellulose acetate. These fiber properties can be further enhanced by increasing residence time in the spinning cabinet and by increasing the quench air and dope temperature.

Shape factor is calculated as follows:

$S.F.=P_w/(4\ Pi\ A)1/2$ $P_w$=Perimeter of the Cross Section.

A=Area of the Fiber Cross-section.

Example 3

It is desired to determine the amount of water required to make a spinnable dope using cellulose acetate with a DS of 2.5. A series of screening samples are made by adding 15 weight % 2.5 DS cellulose acetate to solutions containing varying amount of water and acetone. These mixtures are made up in 1 quart glass jars which are allowed to mix for 24 hours on a jar tumbler. The solutions are then evaluated visually to determine which mixtures produced a clear dope solution. The results are presented in Table 3. From this data it can be determined that a spinnable dope solution can be made using water levels between 0 and 10 weight percent.

TABLE 3

Results of mixture experiment to determine the amount of water required to make a spinnable dope using cellulose acetate with a DS of 2.5

| Cellulose Acetate (weight %) | Water (weight %) | Acetone (weight %) | Results |
|---|---|---|---|
| 15 | 0* | 85 | CA dissolved. No gels. |
| 15 | 10 | 75 | CA dissolved. No gels. Solution clearer than 0% water sample. |
| 15 | 20 | 65 | Many gels. Thicker than 0% water sample. |
| 15 | 30 | 55 | Partially dissolved pellets still visible as white gels in solution. |
| 15 | 40 | 45 | Like 30% water sample but pellets not as soft. |
| 15 | 50 | 35 | Pellets retained original shape except for sharp corners. |
| 15 | 60 | 25 | Pellets did not dissolve. |

*The cellulose acetate and acetone were not dried so there is a small amount of water in these two components. Usually about 3 weight % of the CA and about 0.8 weight % of the acetone.

Example 4

It is desired to determine the amount of water required to make a spinnable dope using cellulose acetate with a DS of 2.2. A series of screening samples are made by adding 15 weight % 2.2 DS cellulose acetate to solutions containing varying amount of water and acetone. These mixtures are made up in 1 quart glass jars which are allowed to mix for 24 hours on a jar tumbler. The solutions are then evaluated visually to determine which mixtures produced a clear dope solution. The results are presented in Table 4. From this data it can be determined that a spinnable dope solution can be made using water levels between 0 and 30 weight percent.

TABLE 4

Results of mixture experiment to determine the amount of water required to make a spinnable dope using cellulose acetate with a DS of 2.2

| Cellulose Acetate (weight %) | Water (weight %) | Acetone (weight %) | Results |
|---|---|---|---|
| 15 | 0* | 85 | Dope opaque. No visible gels. |
| 15 | 10 | 75 | Clear dope. |
| 15 | 20 | 65 | Dope clearer than 10% water sample. |
| 15 | 30 | 55 | Dope clear like 10% water sample. |
| 15 | 40 | 45 | Pellets have globbed together. Gray color. |
| 15 | 50 | 35 | Pellets lumped together. Whiter than 40% water sample. |
| 15 | 60 | 25 | Pellets retained original shape. Slightly tacky. |

*The cellulose acetate and acetone were not dried so there is a small amount of water in these two components. Usually about 3 weight % of the CA and about 0.8 weight % of the acetone.

Example 5

It is desired to determine the amount of water required to make a spinnable dope using cellulose acetate with a DS of 1.9. A series of screening samples are made by adding 15 weight % 1.9 DS cellulose acetate to solutions containing varying amount of water and acetone. These mixtures are made up in 1 quart glass jars which are allowed to mix for 24 hours on a jar tumbler. The solutions are then evaluated visually to determine which mixtures produced a clear dope solution. The results are presented in Table 5. From this data it can be determined that a spinnable dope solution can be made using water levels between 10 and 40 weight percent.

TABLE 5

Results of mixture experiment to determine the amount of water required to make a spinnable dope using cellulose acetate with a DS of 1.9

| Cellulose Acetate (weight %) | Water (weight %) | Acetone (weight %) | Results |
|---|---|---|---|
| 15 | 0* | 85 | Formed fine grained lump of partially plasticized gels. |
| 15 | 10 | 75 | Clear dope. No gels. |
| 15 | 20 | 65 | Clear dope. No gels. Like 10% water sample with yellow cast. |
| 15 | 30 | 55 | Almost opaque but does not have any gels. |
| 15 | 40 | 45 | Looks like 30% water sample. |
| 15 | 50 | 35 | Plasticized lump in bottom of jar. |
| 15 | 60 | 25 | White lump of pellets in clear liquid. |

*The cellulose acetate and acetone were not dried so there is a small amount of water in these two components. Usually about 3 weight % of the CA and about 0.8 weight % of the acetone.

Example 6

It is desired to determine the range of water level that produces spinnable dopes for cellulose acetates with a DS from 1.9 to 2.5. This can be accomplished by combining the results from Examples 1, 3, 4, & 5 (see Table 6).

TABLE 6

Spinnable dope water levels for cellulose acetates with a DS from 1.9 to 2.5

| Cellulose Acetate | Water Level in Dope (weight %) | |
|---|---|---|
| Degree of Substitution | Lower Limit | Upper Limit |
| 1.9 | 10 | 40 |
| 2.1 | 10 | 40 |
| 2.2 | 0 | 30 |
| 2.5 | 0 | 10 |

This data can then be used to plot a range of water levels of spinnable dopes made with cellulose acetate with a DS from 1.9 to 2.5. This continuous range can be broken down into increments of 0.1 DS and a range of water levels for spinnable dopes defined for each increments (see Table 7).

TABLE 7

Spinnable dope water levels for cellulose acetate with a DS from 1.9 to 2.5 broken down into 0.1 DS increments

| Ranges of Cellulose Acetate | Water Level in Dope (weight %) | |
|---|---|---|
| Degree of Substitution | Lower Limit | Upper Limit |
| 1.9 to 2.0 | 10 | 40 |
| 2.0 to 2.1 | 10 | 40 |
| 2.1 to 2.2 | 5 | 35 |
| 2.2 to 2.3 | 0 | 27 |
| 2.3 to 2.4 | 0 | 20 |
| 2.4 to 2.5 | 0 | 13 |

I claim:

1. A method for the production of cellulose acetate fibers comprising (I) forming a solution consisting essentially of (a) about 10 to 40 weight percent, based on the total weight of (a), (b), and (c), of cellulose acetate having a DS/AGU of from 1.9 to 2.2;

(b) about 20 to 85 weight percent, based on the total weight of (a), (b), and (c), of acetone;

(c) about 5 to 40 weight percent, based on the total weight of (a), (b), and (c), of water;

said solution having a zero shear viscosity at 29° C. of about 100 to about 10,000 poise;

(II) filtering said solution to form a spinning solution; followed by (III) spinning said spinning solution at a temperature of about 25° C. to 95° C., at 200 to 1,500 meter/min. through spinnerette holes having a hole area equivalent to a circular diameter of 20 to 100 microns and length to diameter ratio of 0.5 to 3, thereby forming a cellulose acetate fiber having a dry linear density of 0.5 to 20 denier per filament and a total product denier of from 10,000 to 100,000 denier.

2. The method of claim 1, wherein the concentration of water is about 10 to about 40 weight percent, and the DS/AGU of the cellulose acetate is from about 1.9 to 2.1.

3. The method of claim 1, wherein the concentration of water is about 5 to about 35 weight percent and the DS/AGU of the cellulose acetate is from about 2.1 to 2.2.

4. The method of claim 1, wherein the concentration of water is about 10 to 15 weight percent.

5. The method of claim 1, wherein said solution has a zero shear viscosity at 29° C. of between about 200 and 4000 poise.

6. The method of claim 1, wherein said solution has a zero shear viscosity at 29° C. of between about 300 and 3000 poise.

* * * * *